US007629747B2

(12) United States Patent
Hur et al.

(10) Patent No.: US 7,629,747 B2
(45) Date of Patent: Dec. 8, 2009

(54) PLASMA DISPLAY PANEL HAVING SPECIFIC ELECTRODE STRUCTURE

(75) Inventors: Min Hur, Suwon-si (KR); Hyea-Weon Shin, Suwon-si (KR); Takahisa Mizuta, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 520 days.

(21) Appl. No.: 11/246,119

(22) Filed: Oct. 11, 2005

(65) Prior Publication Data

US 2006/0087234 A1 Apr. 27, 2006

(30) Foreign Application Priority Data

Oct. 21, 2004 (KR) ..... 10-2004-0084392

(51) Int. Cl.
*H01J 17/49* (2006.01)

(52) U.S. Cl. ..... 313/584; 313/585; 313/586

(58) Field of Classification Search ..... 313/582, 313/584, 585, 586
See application file for complete search history.

(56) References Cited

U.S. PATENT DOCUMENTS

| | | | | |
|---|---|---|---|---|
| 2001/0011869 | A1 * | 8/2001 | Nakajima et al. | 313/586 |
| 2003/0168977 | A1 * | 9/2003 | Hashikawa | 313/582 |
| 2005/0264203 | A1 * | 12/2005 | Hur et al. | 313/583 |
| 2005/0280368 | A1 * | 12/2005 | Ahn | 313/582 |
| 2006/0001675 | A1 * | 1/2006 | Kwon et al. | 345/584 |
| 2006/0103304 | A1 * | 5/2006 | Hur et al. | 313/567 |

FOREIGN PATENT DOCUMENTS

| | | | |
|---|---|---|---|
| JP | 07-105856 | | 4/1995 |
| JP | 09-035641 | | 2/1997 |
| JP | 2000-100334 | | 4/2000 |
| JP | 2000-331615 | | 11/2000 |
| JP | 2002-170493 | | 6/2002 |
| JP | 2003-151449 | * | 5/2003 |
| JP | 2003-151449 | A1 | 5/2003 |
| JP | 2003-257321 | | 9/2003 |
| JP | 2003-272534 | | 9/2003 |
| JP | 2004-273265 | * | 9/2004 |
| JP | 2004-273265 | A1 | 9/2004 |

* cited by examiner

*Primary Examiner*—Karabi Guharay
(74) *Attorney, Agent, or Firm*—H.C. Park & Associates, PLC

(57) ABSTRACT

The invention provides a plasma display panel having improved luminous efficiency. The improved luminous efficiency may result in part from at least the configuration and/or arrangement of facing sustain and scan electrodes. In one embodiment, the electrodes may have concave portions that are selectively formed at locators where the electrodes intersect barrier ribs that separate adjacent discharge cells of different colors. This configuration may reduce the charge distribution around the portions where the concave are formed, and may also prevent erroneous discharge from being transferred to adjacent discharge cells. The principles of the invention may be used to produce or light density PDP that increases luminous efficiency and decreases a discharge firing voltage.

15 Claims, 10 Drawing Sheets

PLASMA DISPLAY PANEL HAVING SPECIFIC ELECTRODE STRUCTURE

CROSS REFERENCE TO RELATED APPLICATIONS

This application claims priority to and the benefit of Korean Patent Application No. 10-2004-0084392, filed on Oct. 21, 2004 in the Korean Intellectual Property Office, the entire content of which is incorporated herein by reference.

BACKGROUND OF THE INVENTION

1. Field of the Invention

The present invention relates to a plasma display panel, and more particularly, to a plasma display panel in which a plasma discharge is induced by a facing discharge of electrodes disposed to face each other.

2. Description of the Related Art

Generally, a plasma display panel (hereinafter, referred to as 'PDP') is a display device in which vacuum ultraviolet rays are emitted from plasma by gas discharge to excite phosphors to generate visible light, thereby displaying images. In such a PDP, a large screen of 60 inches or more can be implemented with a thickness of no more than 10 cm. Further, the PDP is a self-emitting device, like the CRT, that reproduces superior color without distortion and has a large viewing angle. In addition, due to its simple manufacturing process, the PDP has an advantage over the LCD or the like in view of productivity and cost and thus has been spotlighted as a next-generation industrial flat panel display and a home TV display.

The structure of the PDP has been developed since the 1970s, and at present time, a three-electrode surface-discharge type structure is generally used. In the three-electrode surface-discharge type structure, a front substrate has a pair of electrodes disposed on the same surface, and a rear substrate is spaced at a predetermined distance from the front substrate. The rear substrate has an address electrode extending to intersect the pair of electrodes. A discharge gas is sealed between the front substrate and the rear substrate. In general, whether the sustain discharge occurs is determined by the address discharge between scan electrodes, which are connected to lines, respectively, and which are controlled independently, and address electrodes that are disposed to face the scan electrodes. A sustain discharge proportionate to display brightness is performed by the pair of electrodes on the front substrate.

Meanwhile, the PDPs that are now available on the market may have the resolution of XGA 1024×768 in a 42-inch size. In the end, there is a need for display devices that can display an image of a full-HD (High Definition) level. In a PDP, in order to display the image of the full-HD level (1920×1080), the size of each discharge cell should be reduced. In other words, the discharge cells are disposed with high density.

In the PDP having the three-electrode surface-discharge type structure, a reduction in size of the discharge cell means a reduction in length and area of an electrode. This may result in a reduction in brightness and efficiency of the PDP and increase in a discharge firing voltage. Thus, with the PDP having the high density, there has been a need for a structure different from the structure in which an address discharge is generated by a facing discharge and in which a sustain discharge is generated by a surface discharge.

Meanwhile, FIG. 11 is a graph showing the changes in discharge firing voltage in a surface discharge type electrode structure and a facing discharge type electrode structure while changing the partial pressure of a xenon gas having superior discharge efficiency. In this experiment, a discharge gap between electrodes of the surface discharge type electrode structure is set to 60 μm, a discharge gap between electrodes of the facing discharge type electrode structure is set to 250 μm, and an internal pressure is set to 450 Torr.

These experiment results will now be examined considering the fact that the discharge firing voltage is proportional to the partial pressure of the discharge gas and the distance between the electrodes. Even though there was the difference of about 190 μm in the discharge gap, there was only a difference of about 20 V in the discharge firing voltage. This means that the facing discharge type electrode structure may be more advantageous than the surface discharge type electrode structure when using a plasma discharge.

SUMMARY OF THE INVENTION

Embodiments of the invention may provide a plasma display panel in which a plasma discharge is induced using a facing discharge type electrode structure.

The invention may also provide a plasma display panel in which crosstalk due to erroneous discharge between neighboring discharge cells emitting visible lights of different colors is reduced and/or eliminated.

According to an aspect of the invention, a plasma display panel may include a first substrate and a second substrate that are disposed to face each other, barrier ribs that are disposed in a space between the first substrate and the second substrate and that define a plurality of discharge cells, address electrodes that are formed in parallel with each other and in a predetermined direction on the second substrate, first electrodes and second electrodes that are formed on the second substrate in a direction intersecting the address electrodes to be spaced apart from the address electrodes, and phosphor layers that are formed within the discharge cells. In this case, the first electrodes and the second electrodes may protrude toward the first substrate in a direction away from the second substrate to face each other with a space therebetween, and the first electrodes and the second electrodes may have concave portions that are selectively formed at intersections where the first electrodes and the second electrodes intersect the barrier ribs.

BRIEF DESCRIPTION OF THE DRAWINGS

These and/or other aspects and advantages of the invention will become apparent and more readily appreciated from the following description of the embodiments, taken in conjunction with the accompanying drawings.

DETAILED DESCRIPTION

Preferred embodiments of the present invention will now be described in detail with reference to the drawings so that an ordinary skilled person in the art can easily implement the present invention. However, it should be understood that the present invention can be implemented in various manners but is not limited by the embodiments described or shown herein.

Figure 1:
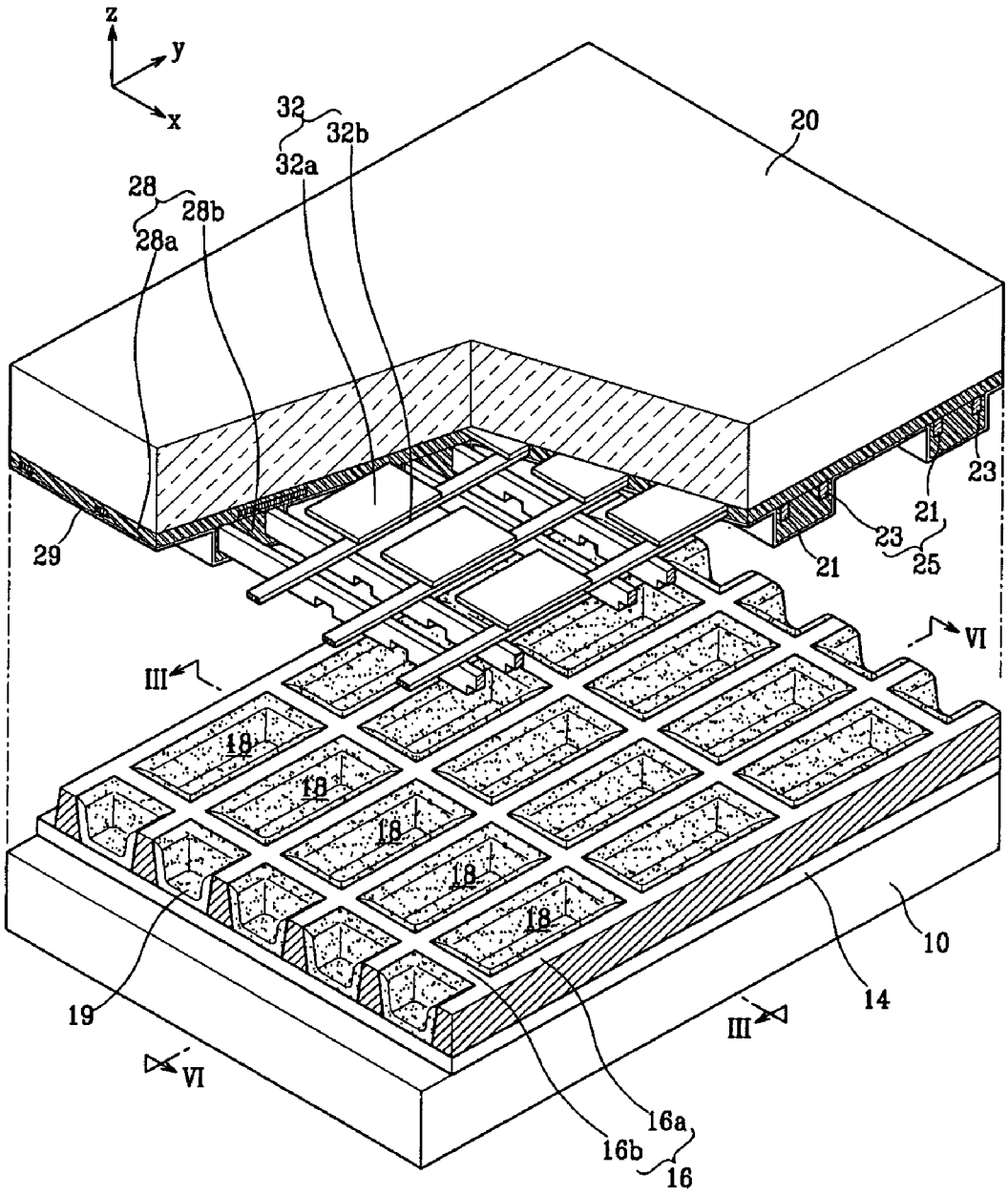
FIG. 1 is a partially exploded perspective view of a plasma display panel according to a first embodiment of the present invention.
Figure 2:
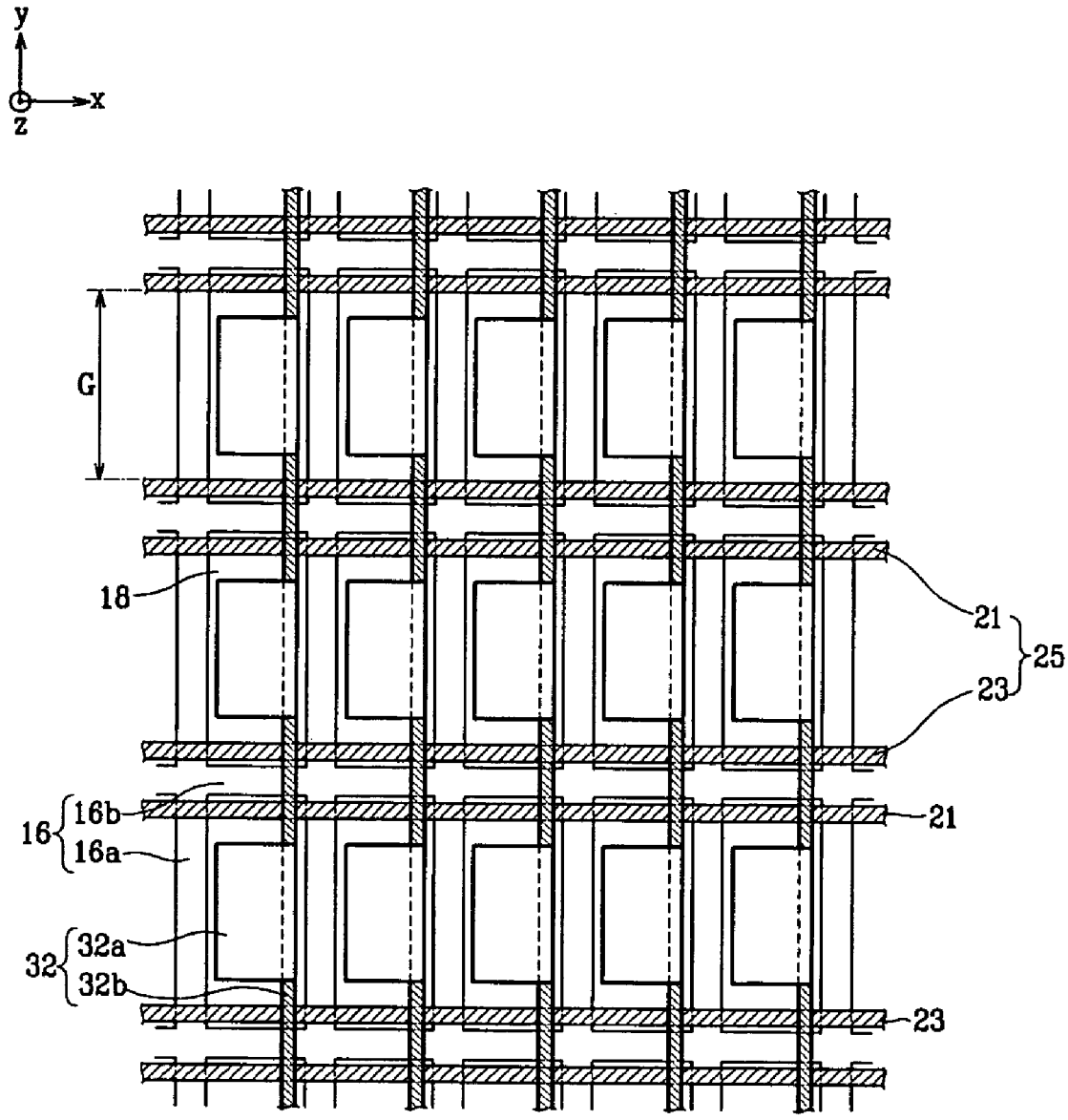
FIG. 2 is a partial plan view schematically showing the structure of electrodes and discharge cells in the plasma display panel shown in FIG. 1.
Figure 3:
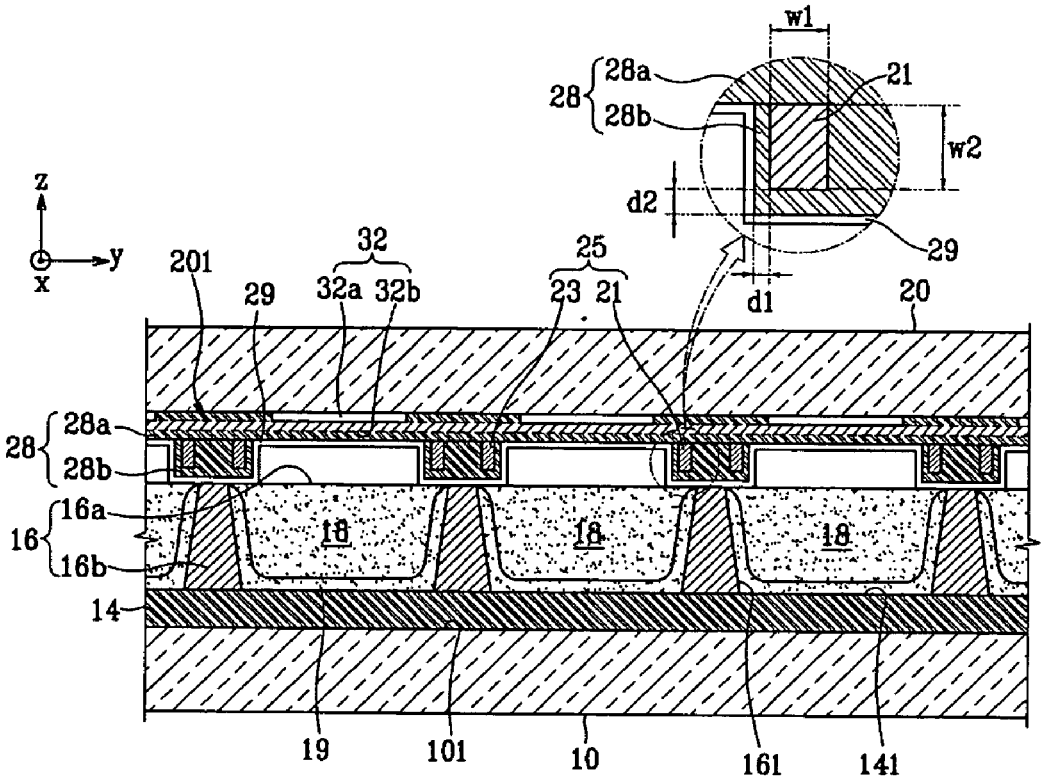
FIG. 3 is a cross-sectional view of the plasma display panel according to the present embodiment taken along the line VI-VI of FIG. 1.

FIG. 1 is a partially exploded perspective view of a plasma display panel according to a first embodiment of the present invention. FIG. 2 is a partial plan view schematically showing the structure of electrodes and discharge cells in the plasma display panel shown in FIG. 1. FIG. 3 is a cross-sectional view of the plasma display panel according to the present embodiment taken along the line VI-VI of FIG. 1.

Referring to FIGS. 1, 2 and 3, a plasma display panel manufactured according to the principles of the invention may include a first substrate 10 (hereinafter, referred to as 'rear substrate') and a second substrate 20 (hereinafter, referred to as 'front substrate'), which are disposed to face each other with a predetermined interval therebetween. A space between both substrates 10 and 20 is divided into a plurality of discharge cells 18 by barrier ribs 16. Phosphor layers 19, which absorb vacuum ultraviolet rays and emit visible light, are formed within the discharge cells 18 along side surfaces 161 of the barrier ribs 16 and bottom surfaces 141 of the discharge cells 18. The discharge cells 18 are filled with a discharge gas (e.g., a mixed gas of xenon (Xe), neon (Ne), etc.), that can be used to generate a plasma discharge.

Address electrodes 32 are formed in parallel to one another with predetermined intervals on the inner surface 201 of the front substrate 20 in one direction (y axis direction in the drawing). A dielectric layer 28 is formed on the entire inner surface of the front substrate 20 so as to cover the address electrodes 32.

Display electrodes 25 are formed on the dielectric layer 28, and are electrically isolated from the address electrodes 32 by the dielectric layer 28 therebetween.

A dielectric layer 14 is formed on the inner surface 101 of the rear substrate 10. The barrier ribs 16 are formed on the dielectric layer 14. In the present embodiment, the barrier ribs 16 include first barrier rib members 16*a* that extend in a direction parallel to the address electrodes 32, and second barrier rib members 16*b* that intersect the first barrier rib members 16*a*. The intersecting barrier ribs 16*a* and 16*b* define the discharge cells 18 into independent discharge spaces. It is, however, to be noted that the barrier rib structure is not limited to the above-described structure, but a stripe-shaped barrier rib structure having only barrier rib members parallel to the address electrodes 32 may be used. Furthermore, various kinds of barrier rib structures that define the discharge cells 18 may be applied to the present invention.

Furthermore, as another example, the barrier ribs 16 may be formed directly on the rear substrate 10.

Referring to FIG. 2, each of the display electrodes 25 includes a first electrode 21 (hereinafter, referred to as 'sustain electrode') and a second electrode 23 (hereinafter, referred to as 'scan electrodes'), which correspond to each of the discharge cells 18. The sustain electrodes 21 and the scan electrodes 23 extend in a direction intersecting the address electrodes 32 (x axis direction in the drawing). The sustain electrodes 21 and the scan electrodes 23 are formed in such a manner, and can be constructed, that they have different functions depending on a type of electrical signals that are applied. Thus, the functions of electrodes 21 and 23 may be reversed. It should be noted that these terms are not intended to limit the present invention.

In the present embodiment, each of the address electrodes 32 includes a bus electrode 32*b* and a protruded electrode 32*a*. The bus electrode 32*b* extends in a direction intersecting the display electrodes 25 along one edge of each of the discharge cells 18 (a first barrier rib member 16*a* in a y axis direction in FIG. 2), while crossing the discharge cell 18. The protruded electrode 32*a* extends into the discharge cells 18 from the bus electrode 32*b* to the barrier rib member 16*a* that faces the protruded electrode 32*a*. The protruded electrode 32*a* can be made of a transparent electrode, an ITO (Indium Tin Oxide) electrode, or the like in order to secure the aperture ratio of the panel. The bus electrode 32*b* is preferably made of a metal electrode in order to compensate for high resistance of the transparent electrode and to have superior conductivity.

Meanwhile, the sustain electrode 21 and the scan electrode 23 protrude toward the rear substrate 10 in a direction away from the front substrate 20 (negative z axis direction in the drawing), and thus face each other with a space therebetween to form a discharge gap G. The resultant discharge gap G can be used to induce a facing discharge between the sustain electrode 21 and the scan electrode 23 that face each other.

Further, in sections obtained by cutting the sustain electrode 21 and the scan electrode 23 with planes perpendicular to longitudinal directions thereof, a length w1 in a direction parallel to the substrates 10 and 20 (a y axis direction in the drawing) can be smaller than a length w2 in a direction perpendicular to the substrates 10 and 20 (a z axis direction in the drawing) (see FIG. 3).

Specifically, the height w2 of the transverse section of the sustain electrode 21 and the scan electrode 23 can be greater than the width w1 thereof. Increasing the height w2 of the transverse section of the sustain electrode 21 or the scan electrode 23 may compensate for a reduction in size of the sustain electrode 21 or the scan electrode 23 even if the planar size of the discharge cell is reduced sufficiently to implement a high-density display.

Furthermore, the sustain electrodes 21 and the scan electrodes 23 may be formed on a layer different from a layer on which the address electrodes 32 are formed and may be electrically isolated from each other. To this end, each of dielectric layers 28 is divided into a first dielectric layer 28*a* and a second dielectric layer 28*b*. That is, the first dielectric layer 28*a* is formed to cover the address electrodes 32 on the front substrate 20. The display electrodes 25, each having the sustain electrode 21 and the scan electrode 23, are formed on the first dielectric layers 28*a*. The second dielectric layer 28*b* is then formed to surround the display electrodes 25.

In this embodiment, the first dielectric layer 28*a* and the second dielectric layer 28*b* can be made of the same or similar material. In addition, the sustain electrodes 21 and the scan electrodes 23 may be made of metal or a metal alloy.

When forming the second dielectric layer 28*b* to surround the sustain electrodes 21 and the scan electrodes 23, a thickness d2 of the second dielectric layer 28*b* formed on the surface where the sustain electrodes 21 and the scan electrodes 23 are oriented toward the rear substrate 10 is larger than a thickness d1 of the second dielectric layer 28*b* formed on the surface where the sustain electrodes 21 and the scan electrodes 23 face each other, as shown in FIG. 3.

This application of dielectric layers of different thickness may prevent generation of erroneous discharge between the electrodes in adjacent discharge cells during the time when the sustain discharge occurs.

A MgO protective film 29 may be formed on the first dielectric layer 28*a* and the second dielectric layer 28*b* to prevent ions from colliding against the dielectric layer during the plasma discharge. This MgO protective film 29 may increase the discharge efficiency since the emission coefficient of secondary electrons is high when the ions collide against the protective film 29.

Figure 4:
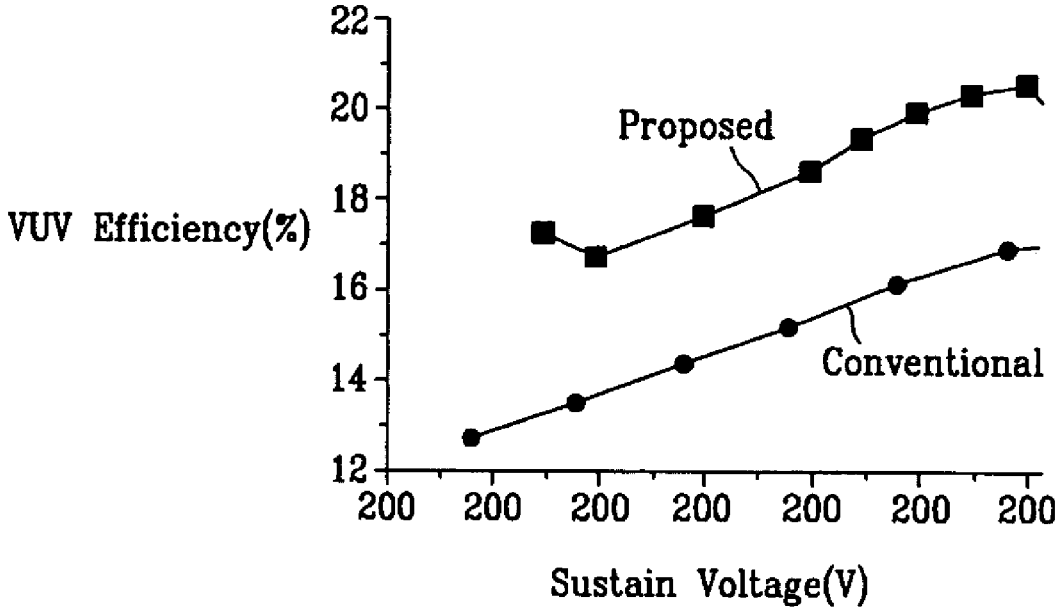
FIG. 4 is a graph showing comparison results of a vacuum ultraviolet efficiency according to a discharge sustaining voltage in the plasma display panel and a surface-discharge three-electrode structure in the related art.

FIG. 4 is a graph showing comparison results of vacuum ultraviolet ray efficiency according to a discharge sustaining voltage in a plasma display panel and a surface-discharge three-electrode structure in the related art.

Referring to the graph, when calculating the vacuum ultraviolet ray efficiency while changing the discharge sustaining voltage in the plasma display panel of the Full-HD level, the luminous efficiency of the plasma display panel according to the first embodiment of the present invention is about 38% higher in the minimum discharge sustaining voltage region where the plasma display panel is driven than the luminous efficiency of the surface-discharge three-electrode structure of prior designs.

As such, if the address electrodes 32 are disposed on the front substrate 20, all the electrodes that are involved in the discharge within the discharge cells 18 are disposed on the front substrate 20. This arrangement permits the discharge spaces defined by the barrier ribs 16 formed on the rear substrate 10 to be further increased. The larger discharge spaces create a large area on which phosphors are coated, and thus contribute to increased luminous efficiency. Further, since charges are not accumulated on phosphors, it is possible to prevent the life span of the phosphors from shortening due to ion sputtering, etc.

Furthermore, since the scan electrodes 23 and the address electrodes 32 that are involved in the address discharge are disposed close to each other, an address voltage can be lowered. Further, since the facing discharge is induced between the sustain electrodes 21 and the scan electrodes 23, a long gap discharge having good luminous efficiency can be generated. This makes it possible to obtain high luminous efficiency compared to the surface-discharge structure of the related art.

Further, when the principles of the invention are used to create a high density PDP and the size of the discharge cell decreases, main problems, such as the reduction in luminous efficiency and brightness, and the increase in a discharge firing voltage, which are generated in the surface-discharge structure in the related art, may be solved.

Figure 5:
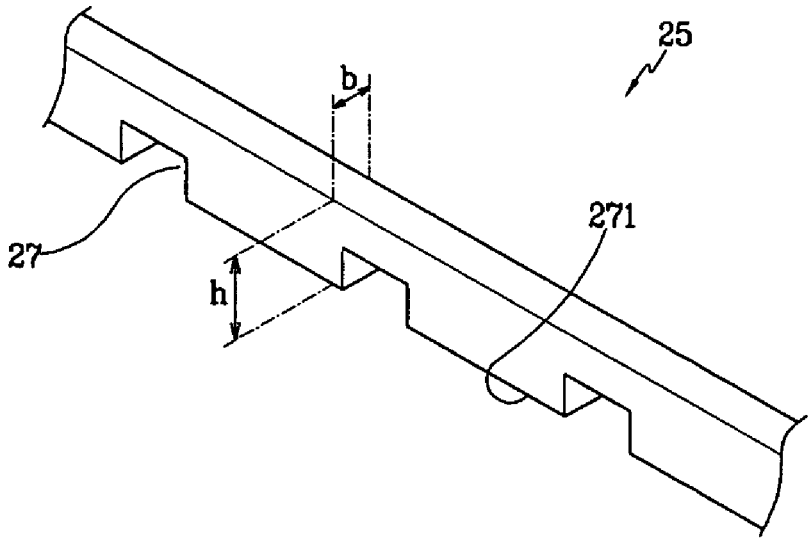
FIG. 5 is a selectively expanded perspective view of the electrodes shown in FIG. 1.
Figure 6:
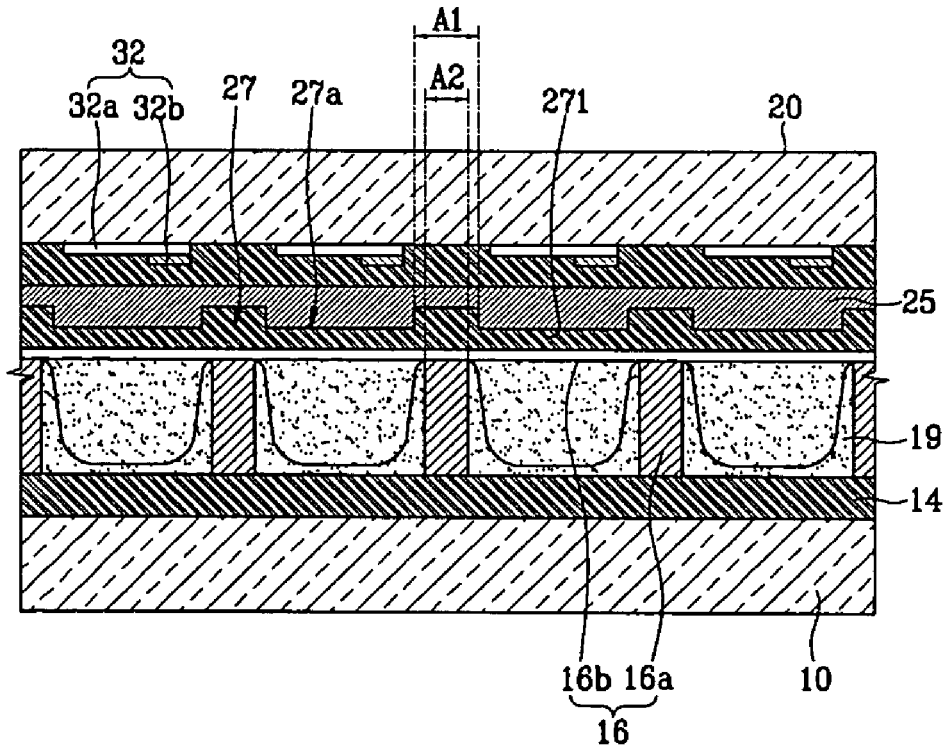
FIG. 6 is a cross-sectional view of the plasma display panel according to the present embodiment taken along the line III-III of FIG. 1.

FIG. 5 is a selectively expanded perspective view of the electrodes shown in FIG. 1. FIG. 6 is a cross-sectional view of the plasma display panel taken along the line III-III of FIG. 1.

As shown in FIG. 5, the section of the display electrode 25 according to the present embodiment has a square shape in which a height h is greater than a width b. In addition, the display electrode 25 has a bar shape that extends along one axis. Concave portions 27 are formed in portions of the display electrodes 25. The concave portions 27 are selectively formed at intersections where the display electrodes 25 and the barrier ribs 16 intersect each other. That is, the concave portions 27 are disposed directly over the barrier ribs 16, and are formed in a longitudinal direction of the display electrodes 25 at approximately constant intervals.

Meanwhile, the concave portions 27 may be formed by selectively removing the bottom surfaces 271 of the display electrode 25, which are oriented toward top surface of the barrier ribs 16. Accordingly, a portion 27*a* between adjacent concave portions 27 has a shape that protrudes toward the discharge cell 18 (see FIG. 6).

In one embodiment, the concave portion 27 is preferably formed to have a width A1 greater than a width A2 of the barrier rib 16 that faces the concave portion 27 so that the concave portion 27 can surround the barrier rib 16. In this embodiment, the portion 27*a* between adjacent concave portions corresponds to the discharge cell 18.

Figure 7:
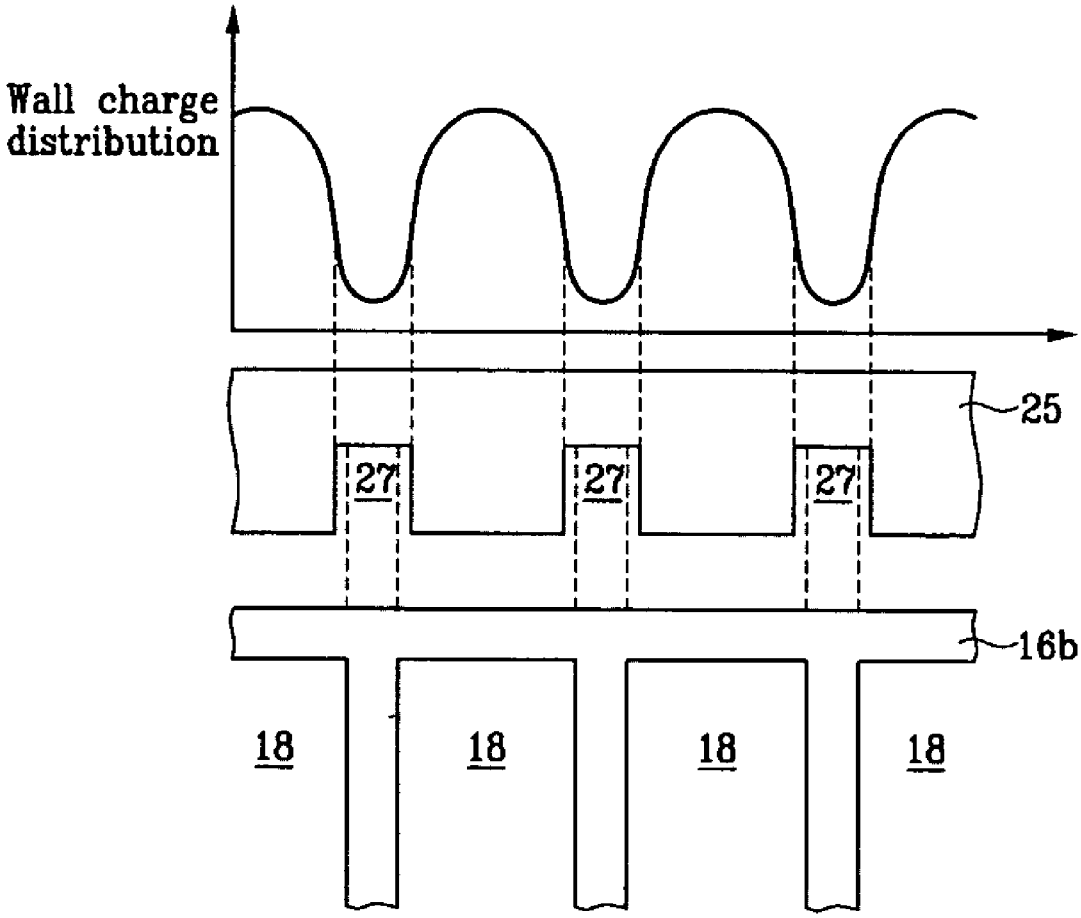
FIG. 7 is a diagram illustrating the distribution amount of wall charges according to the positions of the electrodes.

Furthermore, by forming the concave portion 27 in this manner, an area where the sustain electrode 21 and the scan electrode 23 face each other within the discharge cell 18 is greater than an area where the sustain electrode 21 and the scan electrode 23 face each other over the barrier rib 16. A difference in the area between the opposite portions changes the distribution of wall charges within the discharge cell, as shown in FIG. 7. Consequently, this arrangement may prevent cross-talk between adjacent discharge cells 18 of different colors.

Referring to FIG. 7, variations in distribution of wall charges in one discharge cell indicate Gaussian distribution where the distribution of wall charges is symmetrical to the center of the discharge cell. More particularly, it can be seen that the distribution of the wall charges abruptly decreases in the boundary of the concave portions. This leads to abrupt change in a voltage level in the vicinity of the barrier ribs 18. Such a change in the voltage level substantially serves as a shield between adjacent discharge cells 18 with the barrier rib 16 therebetween. Consequently, this arrangement may prevent cross-talk between adjacent discharge cells 18.

Figure 8:
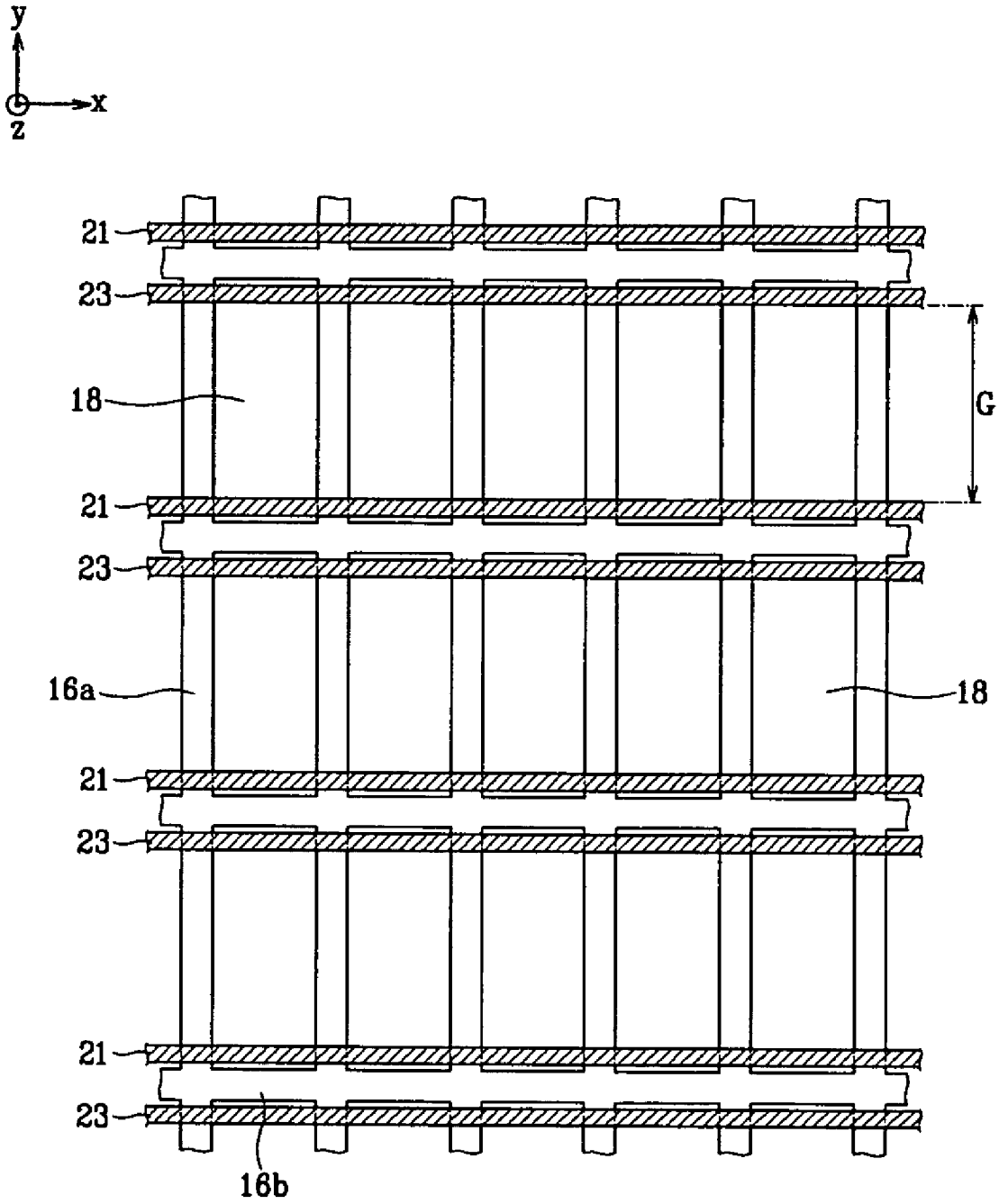
FIG. 8 is a diagram schematically showing the arrangement relationship of the electrodes depending upon the discharge cells in the plasma display panel according to the first embodiment of the present invention.

Meanwhile, FIG. 8 is a view schematically showing the arrangement relationship of electrodes depending upon discharge cells in the plasma display panel according to the first embodiment of the present invention. For convenience of explanation, the address electrodes are omitted in FIG. 8.

A shape in which sustain electrodes 21 and scan electrodes 23 are disposed according to discharge cells 18 will now be described with reference to FIG. 8.

In this first embodiment, the sustain electrodes 21 and the scan electrodes 23 face each other with the discharge cells 18 therebetween, thereby forming the discharge gaps G. The sustain electrodes 21 and the scan electrodes 23 are also formed to correspond to the discharge cells 18, respectively.

In detail, the sustain electrodes 21 and the scan electrodes 23 are arranged within the discharge cells 18 and disposed to be adjacent to the barrier ribs 16 that define the discharge cells 18. Therefore, the sustain electrodes 21 and the scan electrodes 23 are disposed to face each other with the discharge cells 18 therebetween.

Further, in the relationship between the discharge cells 18 that are adjacent to each other in a longitudinal direction of the first barrier rib members 16*a*, the sustain electrode 21 and the scan electrode 23 are arranged on both sides of the second barrier rib member 16*b*. That is, the sustain electrode 21 is disposed in one discharge cell 18, and a scan electrode 23 on an opposite side of the second barrier rib members 16*b* is disposed in an adjacent discharge cell 18 in a longitudinal direction of the first barrier rib members 16*a*. Consequently, each discharge cell 18 contains a sustain electrode 21 facing a scan electrode 23 across the space of the discharge cell 18.

In other words, the plasma display panel according to the present embodiment has a structure in which the sustain electrode 21 and the scan electrode 23 are disposed to face each other with the discharge cell 18 therebetween, and the sustain electrode 21 and a scan electrode 23 of an adjacent discharge cell 18 are disposed in a pair with the second barrier rib member 16*b* therebetween.

Figure 9:
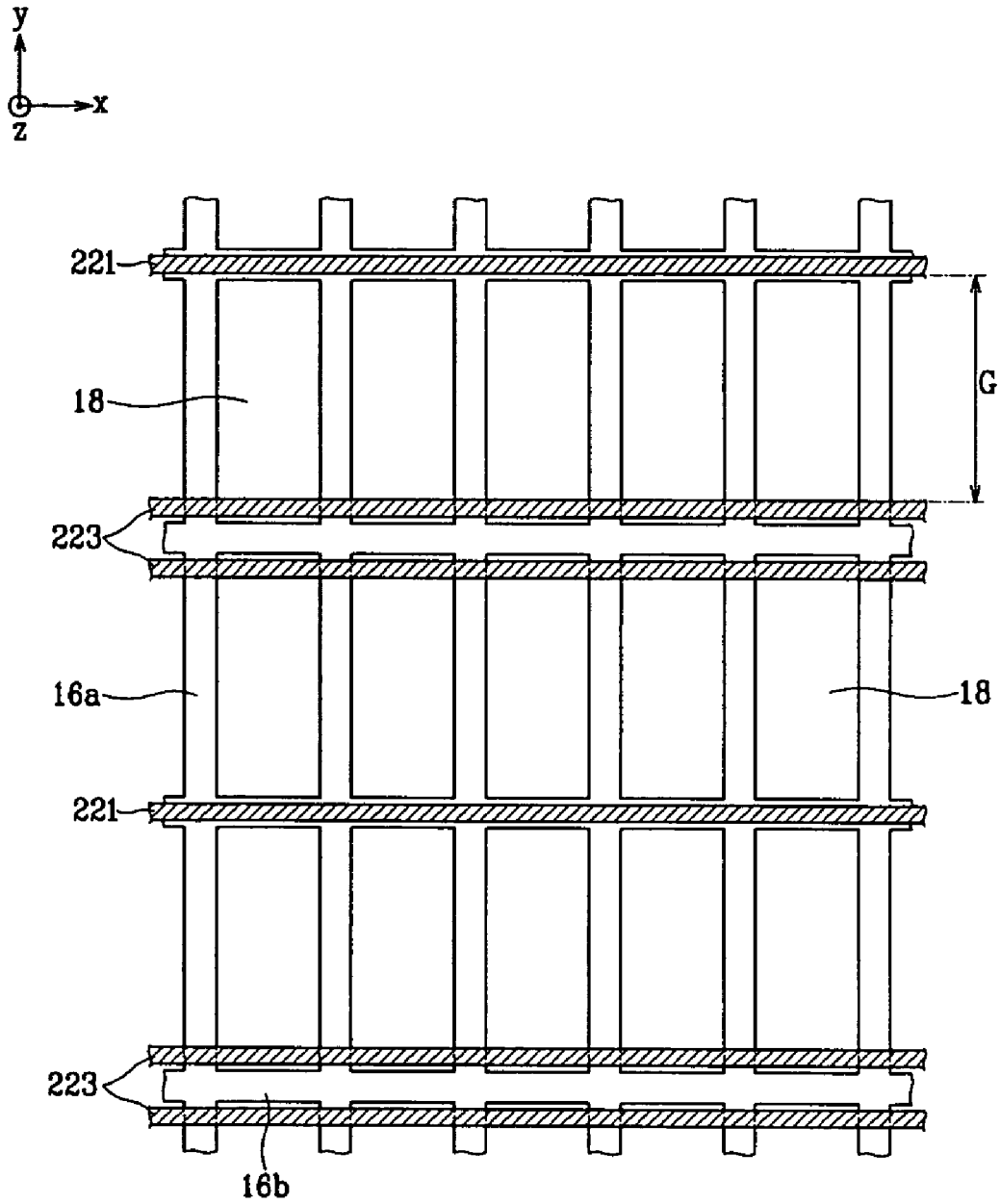
FIG. 9 is a diagram schematically showing the arrangement relationship of the electrodes in a plasma display panel according to a second embodiment of the present invention.

FIG. 9 is a diagram schematically showing the arrangement relationship of electrodes in a plasma display panel according to a second embodiment of the present invention.

As shown in FIG. 9, according to the second embodiment, sustain electrodes 221 are used commonly between adjacent discharge cells 18. Specifically, each of the sustain electrodes 221 is disposed between two adjacent discharge cells 18 in a longitudinal direction of the first barrier rib members 16*a*. Scan electrodes 223 are respectively disposed in the two adjacent discharge cells 18 to face the sustain electrodes 221.

In detail, a pair of the scan electrodes 223 is disposed within both discharge cells 18 (a y axis direction in the drawing), which are defined by a second barrier rib member 16*b*, to be adjacent to the second barrier rib member 16*b*. Further, the sustain electrodes 221 are disposed over the second barrier rib members 16*b* to face the second barrier rib members 16*b*.

As such, the plasma display panel according to the second embodiment has a structure in which the sustain electrodes 221 and the scan electrodes 223 are disposed to face each other with the discharge cells 18 therebetween, and one sustain electrode 221 and a pair of the scan electrodes 223 are alternately disposed along the longitudinal direction of the first barrier rib members 16*a*.

Figure 10:
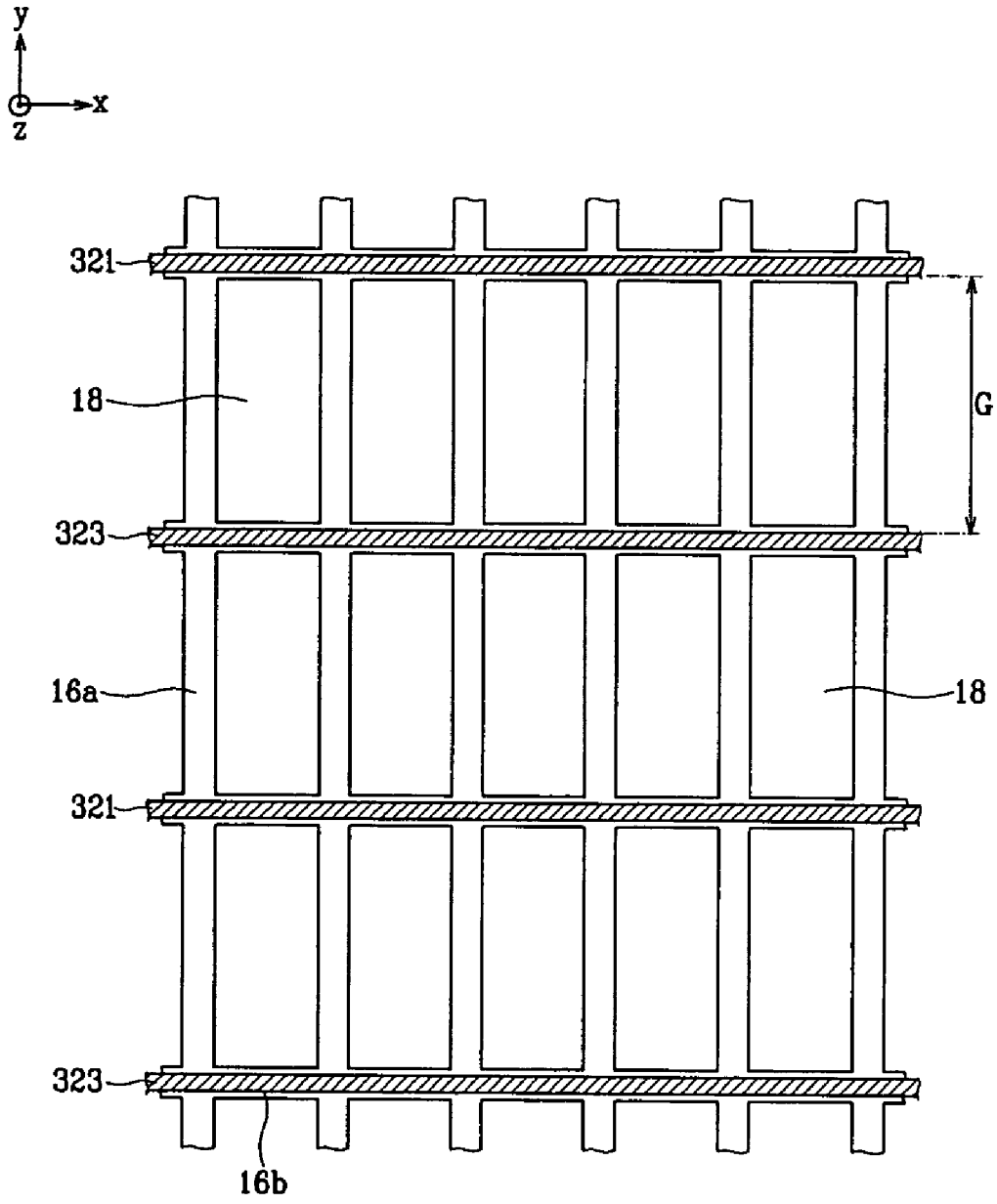
FIG. 10 is a diagram schematically showing the arrangement relationship of electrodes in a plasma display panel according to a third embodiment of the present invention.
Figure 11:
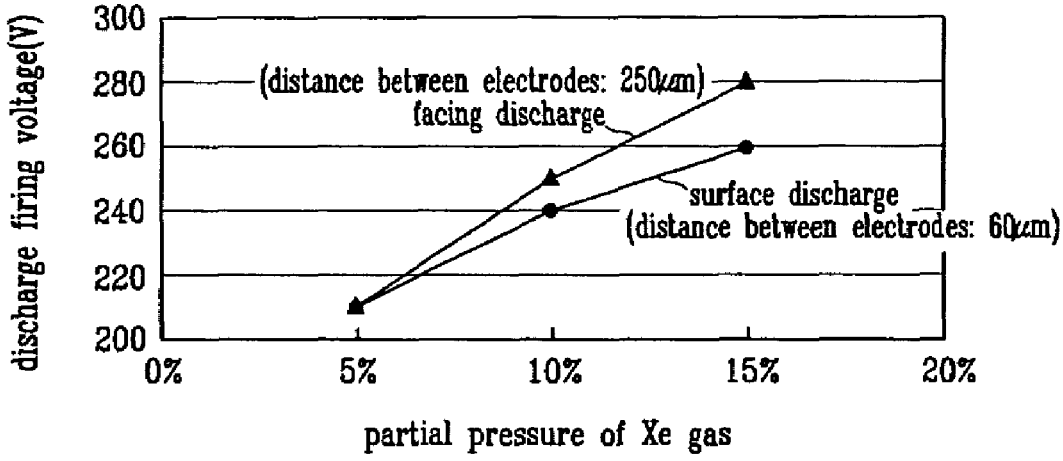
FIG. 11 is a graph showing measurement results of discharge firing voltages in a surface discharge type electrode structure and a facing discharge type electrode structure while changing a partial pressure of a xenon gas.

FIG. 10 is a diagram schematically showing the arrangement relationship of electrodes in a plasma display panel according to a third embodiment of the present invention.

As shown in FIG. 10, according to the third embodiment, sustain electrodes 321 and scan electrodes 323 are disposed corresponding to the second barrier rib members 16*b*, respectively, to face each other. In detail, the sustain electrodes 321 and the scan electrodes 323 are alternately disposed between a pair of adjacent discharge cells 18 having phosphor layers that emit the light of the same color, respectively. In other words, a sustain electrode 321 may be disposed along a second barrier rib member 16*b* that separates adjacent discharge cells 18 that are coated with the same color phosphor. Meanwhile, the sustain electrodes 321 and the scan electrodes 323 are alternately disposed corresponding to the second barrier rib members 16*b* along the direction of the first barrier rib members 16*a*.

As described above, according to the plasma display panel of the present invention, the address electrodes are disposed on the front substrate. Thus, the great discharge spaces that are defined by the barrier ribs formed in the rear substrate can be further secured. This can lead to an increased area on which the phosphors are coated, thereby enhancing the luminous efficiency. Further, as charges are not accumulated on the phosphors, it is possible to prevent the life span of the phosphors from shortening due to ion sputtering, etc.

Furthermore, since scan electrodes and address electrodes that involve in the address discharge are disposed to be close to each other, the address voltage can be lowered. Further, since the facing discharge is induced between sustain electrodes and scan electrodes, the long gap discharge with good luminous efficiency can be performed. It is thus possible to obtain the high luminous efficiency, as compared to the surface discharge structure in the related art.

Furthermore, according to the present invention, concave portions are formed in electrode portions that cross adjacent discharge cells having different colors. This configuration may reduce the charge distribution amount around the portions where the concave portions and may also solve a cross-talk problem in which a discharge due to erroneous discharge is transferred to adjacent discharge cells.

Furthermore, when the principles of the invention are used to produce a high density PDP and the size of the discharge cell becomes small, the main problems, such as the reduction in luminous efficiency and brightness and the increase in a discharge firing voltage, which are generated in the surface discharge structure in the related art, can be solved.

Although the preferred embodiments of the invention have been described hereinabove, the invention is not limited to the embodiments. It should be understood that various modifications may be made that read on the appended claims, the detailed description of the invention, and the accompanying drawings. Such modifications will still fall within the spirit and scope of the invention.

What is claimed is:

1. A plasma display panel, comprising:

a first substrate and a second substrate that are disposed to face each other;

barrier ribs that are disposed in a space between the first substrate and the second substrate and that define a plurality of discharge cells;

address electrodes that are formed substantially in parallel with each other and in a predetermined direction on the second substrate; and first electrodes and second electrodes that are formed on the second substrate in a direction intersecting the address electrodes to be spaced apart from the address electrodes;

wherein the first electrodes and the second electrodes are protruded toward the first substrate in a direction away from the second substrate to face each other with a space there between, wherein the first electrodes and the second electrodes have concave portions that are selectively formed at regions where the first electrodes and the second electrodes intersect the barrier ribs, and wherein, on the second substrate, a first dielectric layer substantially covers the address electrodes, the first electrodes and the second electrodes are formed on the first dielectric layer, and a second dielectric layer substantially surrounds the first electrodes and the second electrodes.

2. The plasma display panel of claim 1, wherein a width of each of the concave portions is larger than that of each of the barrier ribs facing the concave portions.

3. The plasma display panel of claim 1, wherein a portion between adjacent concave portions corresponds to a discharge cell.

4. The plasma display panel of claim 1, wherein the address electrodes extend to correspond to the discharge cells, respectively, and each of the concave portions is disposed between the address electrodes.

5. The plasma display panel of claim 1, wherein a pair of the first electrode and the second electrode is formed to correspond to each of the discharge cells, and the first electrodes and the second electrodes are alternately disposed in a direction where the address electrodes extend.

6. The plasma display panel of claim 1, wherein each of the first electrodes is disposed between a pair of adjacent discharge cells having phosphor layers that emit light of the same color, and the second electrodes are respectively disposed in the pair of discharge cells so as to face each of the first electrodes.

7. The plasma display panel of claim 6, wherein the barrier ribs include first barrier rib members that extend in a direction substantially parallel to the address electrodes, and second barrier rib members that intersect the first barrier rib members so as to define the discharge cells as independent discharge spaces, and the first electrodes are formed corresponding to the second barrier rib members, and the second electrodes are respectively formed inside the discharge cells and near the second barrier rib members.

8. The plasma display panel of claim 1, wherein the first electrodes or the second electrodes are respectively provided to correspond to a pair of adjacent discharge cells having phosphor layers that emit light of the same color, and the first electrodes and the second electrodes are alternately disposed in a direction where the address electrodes extend.

9. The plasma display panel of claim 8, wherein the barrier ribs include first barrier rib members that extend in a direction parallel to the address electrodes, and second barrier rib members that intersect the first barrier rib members so as to define the discharge cells as independent discharge spaces, and the first electrodes and second electrodes are formed corresponding to the second barrier rib members.

10. The plasma display panel of claim 1, wherein the first electrodes and the second electrodes comprise a metal.

11. The plasma display panel of claim 1, wherein each of the address electrodes includes a bus electrode that extends along one edge of each of the discharge cells, and a protruded electrode that extends from the bus electrode inside each of the discharge cells.

12. The plasma display panel of claim 11, wherein the bus electrode comprises a metal.

13. The plasma display panel of claim 11, wherein the protruded electrode comprises a transparent electrode.

14. The plasma display panel of claim 11, further comprising phosphor layers that are formed within the discharge cells.

15. The plasma display panel of claim 14, wherein no or nominal electrical charges are accumulated on the phosphors, thereby increasing a life span of the phosphors.

* * * * *

UNITED STATES PATENT AND TRADEMARK OFFICE

CERTIFICATE OF CORRECTION

PATENT NO. : 7,629,747 B2
APPLICATION NO. : 11/246119
DATED : December 8, 2009
INVENTOR(S) : Hur et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 898 days.

Signed and Sealed this

Second Day of November, 2010

David J. Kappos

David J. Kappos
*Director of the United States Patent and Trademark Office*